US008403075B2

(12) United States Patent
Schlesak et al.

(10) Patent No.: US 8,403,075 B2
(45) Date of Patent: Mar. 26, 2013

(54) WOBBLE DRIVE OF A HAND-HELD POWER TOOL

(75) Inventors: Gerd Schlesak, Tamm (DE); Juergen Lennartz, Ostfildern (DE); Stefan Holst, Ulm (DE); Klaus Kuespert, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 156 days.

(21) Appl. No.: 12/809,936

(22) PCT Filed: Oct. 22, 2008

(86) PCT No.: PCT/EP2008/064254

§ 371 (c)(1),
(2), (4) Date: Jun. 21, 2010

(87) PCT Pub. No.: WO2009/077241

PCT Pub. Date: Jun. 25, 2009

(65) Prior Publication Data

US 2010/0270046 A1 Oct. 28, 2010

(30) Foreign Application Priority Data

Dec. 19, 2007 (DE) ..... 10 2007 061 716

(51) Int. Cl.
*B25D 11/0614* (2006.01)

(52) U.S. Cl. ..... 173/109; 173/201; 173/205

(58) Field of Classification Search ..... 173/47, 173/48, 109, 201, 205; 74/60
See application file for complete search history.

(56) References Cited

U.S. PATENT DOCUMENTS

| | | | | |
|---|---|---|---|---|
| 3,370,510 | A * | 2/1968 | Bunyan | 74/60 |
| 5,050,307 | A * | 9/1991 | Palm | 30/392 |
| 5,555,626 | A * | 9/1996 | Fuchs | 30/393 |
| 5,785,503 | A * | 7/1998 | Ota et al. | 417/269 |
| 6,112,830 | A * | 9/2000 | Ziegler et al. | 173/109 |
| 6,212,781 | B1 * | 4/2001 | Marinkovich et al. | 30/394 |
| 6,481,979 | B2 * | 11/2002 | Huang et al. | 417/269 |
| 2007/0163370 | A1 | 7/2007 | Berger et al. | |
| 2008/0047723 | A1 | 2/2008 | Kamegai et al. | |

FOREIGN PATENT DOCUMENTS

| | | | |
|---|---|---|---|
| DE | 3427342 | A1 | 1/1986 |
| DE | 19851888 | C1 | 7/2000 |
| EP | 1000712 | A2 | 5/2000 |
| EP | 1892062 | A2 | 2/2008 |
| WO | 2005092575 | A1 | 10/2005 |
| WO | WO 2005092575 | A1 * | 10/2005 |

* cited by examiner

*Primary Examiner* — M. Alexandra Elve
*Assistant Examiner* — Nathaniel Chukwurah
(74) *Attorney, Agent, or Firm* — Maginot, Moore & Beck

(57) ABSTRACT

The invention relates to a wobble drive of a hand-held machine tool, particularly a drilling or chipping hammer, having a drive shaft, a wobble bearing disposed on the drive shaft, and a wobble plate supported on the wobble bearing. At least two wobble fingers having wobble finger axes being provided on the wobble plate. The invention provides that the axes of the wobble fingers form an angle different from 180°.

19 Claims, 4 Drawing Sheets

WOBBLE DRIVE OF A HAND-HELD POWER TOOL

CROSS-REFERENCE TO RELATED APPLICATION

This application is a 35 USC 371 application of PCT/EP2008/064254 filed on Oct. 22, 2008.

BACKGROUND OF THE INVENTION

1. Background of the Invention

The invention is based on a wobble drive of a hand-held power tool, in particular a rotary hammer and/or chisel hammer.

2. Description of the Prior Art

DE 198 51 888 A1 has disclosed a wobble drive of a hand-held power tool embodied in the form of a rotary hammer and equipped with a drive shaft. The wobble drive has a wobble bearing situated on the drive shaft and a wobble plate mounted on the wobble bearing. The wobble plate is provided with two wobble fingers, each with a wobble finger axis, that are used for driving an impact mechanism piston and for driving a compensation mass; the two wobble fingers are situated on diametrically opposite sides of the wobble plate.

SUMMARY AND ADVANTAGES OF THE INVENTION

The invention is based on a wobble drive of a hand-held power tool, in particular a rotary hammer and/or chisel hammer, that is equipped with a drive shaft, having a wobble bearing situated on the drive shaft and having a wobble plate mounted on the wobble bearing, provided with at least two wobble fingers, each with a respective wobble finger axis.

According to one proposal, the axes of the wobble fingers enclose an angle $\alpha$ not equal to 180°. In this context, a "wobble drive" should in particular be understood to be a drive unit that transforms or converts a rotary motion of a drive element into an oscillating, translatory motion of a driven element. In this case, a rotation element that is embodied as the drive shaft and is driven in rotary fashion acts on a wobble plate of the wobble drive in a way that causes the wobble plate to tilt back and forth as it rotates around a rotation axis, thus permitting at least one wobble finger to set at least one other element into a linear translatory motion. Wobble drives are used, for example, in hand-held power tools such as a rotary hammers to convert a rotary motion of a drive unit into an oscillating, translatory motion of an impact mechanism piston, which serves to build up a pressure in an air cushion of an impact mechanism of the hand-held power tool and the pressure is used for imparting impacts to a tool. The wobble finger in this case represents an unbalanced mass that chiefly becomes noticeable at high speeds through vibrations or oscillations, noise, and increased wear. In order to eliminate or compensate for this imbalance, it is known to take intentional mass balancing measures in the hand-held power tool. The mass balancing in this case can be positive or negative. As a rule, a positive mass balancing is carried out by means of balancing masses that are used to adjust the center of gravity of the component to be counterbalanced, in this case the wobble finger, so that it coincides with the center point of the rotation axis of the wobble plate. As a result, both main inertia axes of the wobble plate coincide with the rotation axis. In the present exemplary embodiment, a second wobble finger is provided for this purpose on the wobble plate and converts the rotary motion of the drive shaft into a translatory motion of a balancing mass. In this case, at least one of the wobble fingers is preferably oriented obliquely in space. The embodiment according to the invention makes it possible, at least to a large degree, to eliminate the oscillation phenomena caused by inertial forces.

According to one proposal, the axes of the wobble fingers enclose an angle $\alpha$ of between 10° and 170° and/or 190° and 350°. Particularly in rotary hammers, the acceleration force that sets the rotary hammer into oscillations or reciprocating motions is composed of different components. These components chiefly include inertial forces, a compressive force of the rotary hammer, and a force with which the user presses against the rotary hammer. In order to bring the acceleration force into reverse phase with the balancing inertial forces of the rotary hammer, the angle $\alpha$ between the axes of the wobble fingers should preferably be between 10° and 170° and/or 190° and 350°. By means of this, it is possible to achieve an optimal phase angle between the movement of the piston and the movement of the balancing unit so that the oscillations of the rotary hammer can be reduced to a minimum.

The angle between the axes of the wobble fingers is advantageously adjustable. This permits the balancing unit to be very finely adjusted, preferably with infinite variability, thus allowing it to be adapted to all load situations. In particular, this also offers the possibility of using the wobble drive in various hand-held power tools since the angle adjustment permits it to be adapted to any hand-held power tool.

Preferably, the adjustment of the angle $\alpha$ can be carried out by supporting at least one wobble finger in movable fashion on the wobble plate. This constitutes a structurally simple, inexpensive possibility for angle adjustment.

The wobble finger advantageously converts a rotary motion of the drive shaft into a translatory motion of one element and the other wobble finger converts a rotary motion of the drive shaft into a translatory and/or rotary motion of another element. This makes it possible to achieve an optimal phase angle between the motion of a first element and a motion of a second element so that the oscillations of the hand-held power tool can be reduced to a minimum.

According to another proposal, at least one element is guided in linear fashion. Preferably, both elements are guided in linear fashion, making it possible to achieve an optimal balancing of the forces at work during operation of the hand-held power tool.

According to another proposal, the elements are a piston of a hand-held power tool impact mechanism and/or a balancing unit. Advantageously, the balancing unit more or less constitutes a counterweight to the piston of the impact mechanism and produces counter-moments in opposition to the moving masses and moments occurring due to the movements of the piston. This increases the smooth running of the hand-held power tool. Preferably, the piston is guided in linear fashion and the balancing unit is supported so that it can move in linear or rotary fashion.

According to another proposal, the balancing unit is preferably guided essentially in the direction of a machining axis of the hand-held power tool. The expression "essentially in the direction of a machining axis" should in particular be understood to mean that the guidance of the balancing unit has an angular deviation of less than 10° and preferably less than 5° in relation to the machining axis. This permits an optimal balancing of the forces at work in the hand-held power tool since it renders the balancing unit an optimal counterweight to the impact mechanism piston that is likewise guided in the machining direction. In addition, this facilitates assembly of the hand-held power tool since the individual components only have to be arranged more in a main direction in a housing of the hand-held power tool. Alternative to this, the balancing unit can also be guided in a direction of an axis oriented obliquely in space in relation to the machining axis, which encloses an angle of 45°, for example, with the machining axis, i.e. the balancing unit can be oriented obliquely in space.

According to an alternative proposal, the balancing unit can be rotated around a rotation axis. This makes it possible to reduce the oscillations of the hand-held power tool in a simple, inexpensive fashion in that the first wobble finger converts the rotary motion of the drive shaft into a translatory motion of the first element and the second wobble finger converts the rotary motion of the drive shaft into at least a rotary motion of the other element.

The balancing unit is advantageously embodied in the form of a disk-shaped and/or U-shaped component. This makes it possible to embody the component individually with reference to the balancing action, for example by varying the thickness of the component.

In a particularly advantageous embodiment, the balancing unit at least partially encompasses the drive shaft and/or a guide of the piston or more precisely, the drive shaft and/or a guide of the piston extend(s) through the balancing unit. This permits an optimal adaptation of the wobble drive to existing structures, in particular the use of existing space.

BRIEF DESCRIPTION OF THE DRAWINGS

Other advantages ensue from the following description of the drawings. The drawings show two exemplary embodiments of the invention. The drawings, the description, and the claims contain numerous features in combination. Those skilled in the art will also suitably consider the features individually and unite them in other meaningful combinations.

DESCRIPTION OF THE PREFERRED EMBODIMENTS

Figure 1:
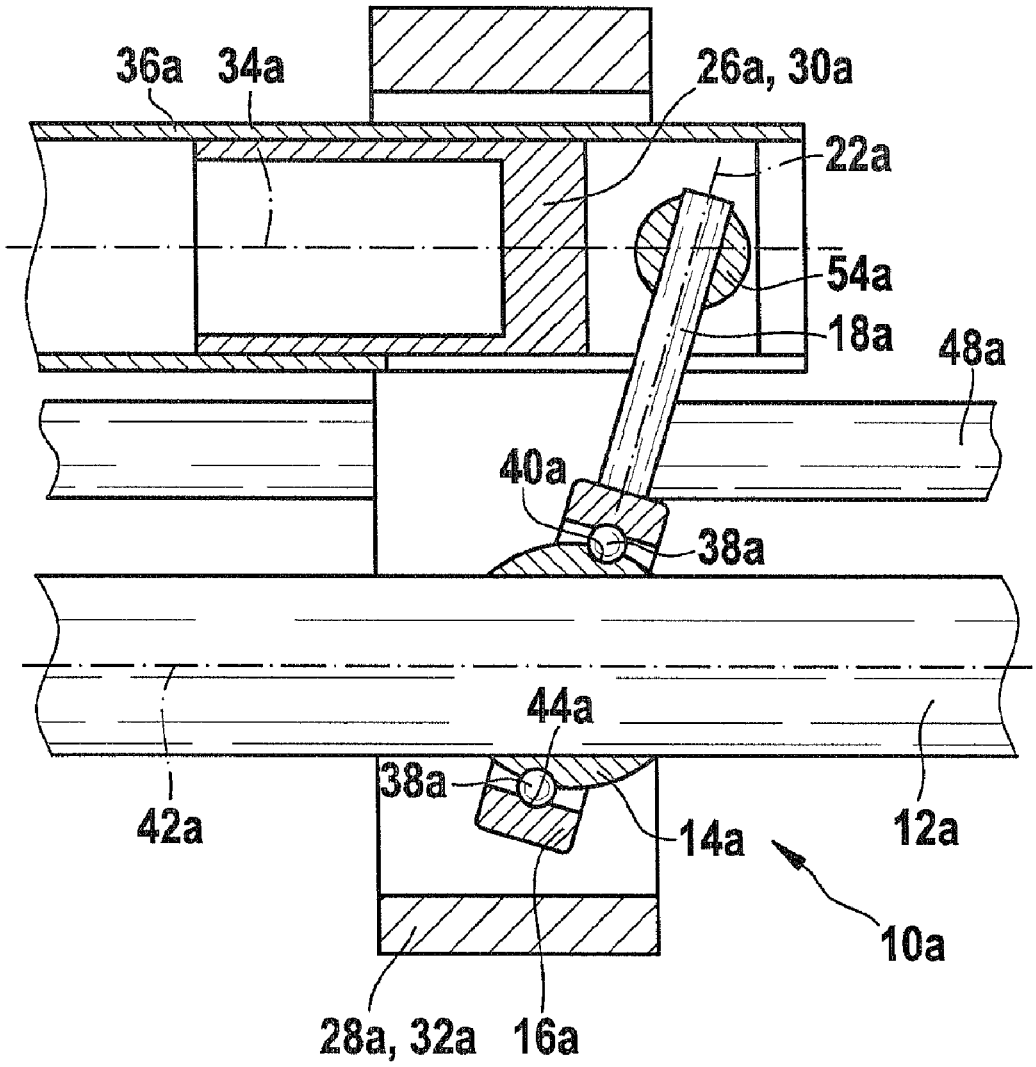
FIG. 1 is a side view of a first embodiment of a wobble drive according to the invention for a hand-held power tool.
Figure 2:
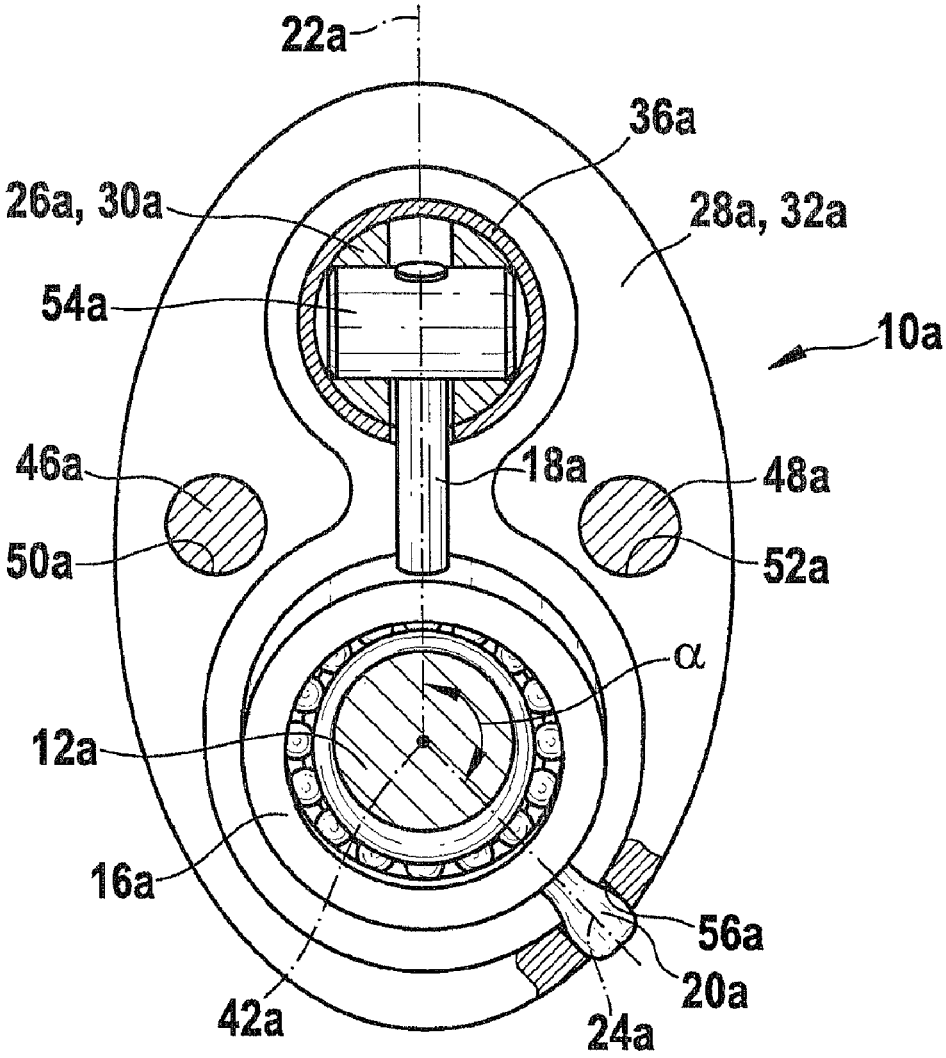
FIG. 2 is a front view of the wobble drive according to the invention shown in FIG. 1.
Figure 3:
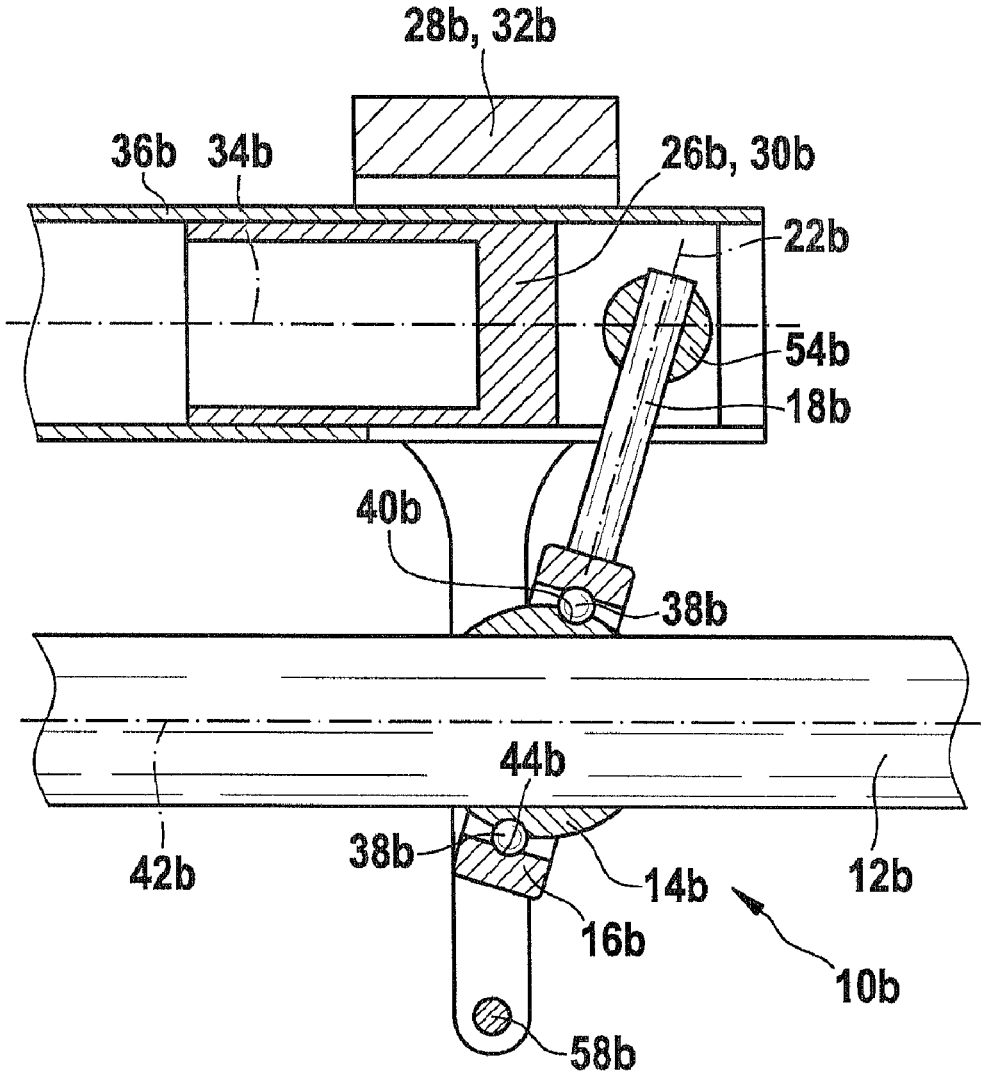
FIG. 3 is a side view of a second embodiment of a wobble drive according to the invention for a hand-held power tool.

FIGS. 1 and 3 show a partially sectional view of a wobble drive 10 of a hand-held power tool that is not shown in detail, of a first and second embodiment respectfully. The first embodiment show is distinguished by a lower case letter "a" following the element numeral, whereas the second embodiment is distinguished by a lower case letter "b" following the element numeral. The hand-held power tool is preferably a rotary hammer. The wobble drive 10 includes a wobble bearing 14, rolling elements 38, and a wobble plate 16 with wobble fingers 18, 20 (see FIGS. 2 and 4 also). The hand-held power tool has a drive shaft 12 to which the wobble drive 10 is fastened by means of the wobble bearing 14. The wobble bearing 14 is fixed to the drive shaft 12 for co-rotation with it. The wobble bearing 14 has an annular inner raceway 40 lying in a plane not perpendicular to a rotation axis 42 of the drive shaft 12. The wobble plate 16 is situated around the wobble bearing 14 and its inner surface is provided with an outer raceway 44 oriented toward the inner raceway 40 of the wobble bearing 14. The rolling elements 38, preferably balls, are arranged in movable fashion between the inner raceway 40 and the outer raceway 44.

Figure 4:
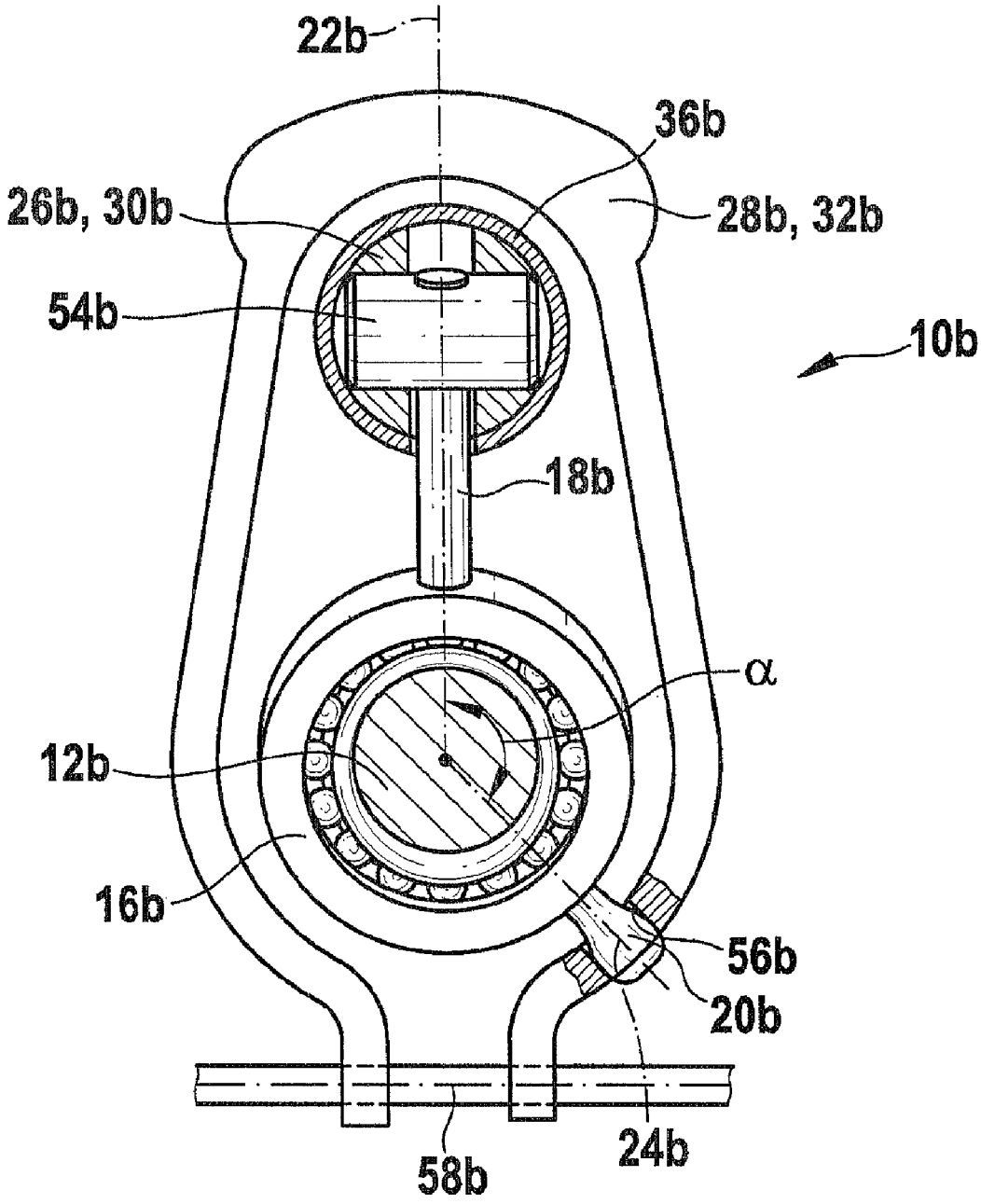
FIG. 4 is a front view of the wobble drive according to the invention shown in FIG. 3.

According to FIGS. 2 and 4, a circumference of the wobble plate 16 is provided with a first wobble finger 18 having a first wobble finger axis 22 and with a second wobble finger 20 having a second wobble finger axis 24, which extend radially outward from the circumference of the wobble plate 16. The wobble fingers 18, 20 in this case can be embodied so that they are of one piece with the wobble plate 16 or can be embodied as separate parts attached to the wobble plate 16.

According to the invention, the axes 22, 24 of the wobble fingers 18, 20 enclose an angle $\alpha$ not equal to 180°. Advantageously, the angle $\alpha$ between the axes 22, 24 of the wobble fingers 18, 20 is adjustable. The angle $\alpha$ can be adjusted through a movable support of at least one of the wobble fingers 18 or 20 on the wobble plate 16, i.e. the wobble finger 18 or 20 can be moved or adjusted on the wobble plate 16. Preferably, the axes 22, 24 of the wobble fingers 18, 20 enclose an angle $\alpha$ of between 10° and 170° and/or 190° and 350°.

The wobble fingers 18, 20 convert a rotary motion of the drive shaft 12 into a translatory and/or rotary motion of at least one respective element 26, 28 in that the wobble fingers 18, 20 are operatively connected to the respective element 26, 28; at least one element 26, 28 is guided in linear fashion, preferably restrictively guided. The elements 26, 28 are comprised on the one hand by a piston 30 of an impact mechanism, not shown in detail, of a hand-held power tool, which is guided in linear fashion in the direction of a machining axis 34 inside a guide 36 embodied in the form of a hammer tube, and on the other hand, by a balancing unit 32.

An end of the first wobble finger 18 remote from the wobble plate 16 is operatively connected to the piston 30 of the impact mechanism by means of a piston bolt 54. An end of the second wobble finger 20 remote from the wobble plate 16 is operatively connected to the balancing unit 32 by means of a recess 56 in the balancing unit 32.

In the first exemplary embodiment according to FIGS. 1 and 2, two longitudinal guides embodied in the form of rods 46*a*, 48*a* guide the balancing unit 32*a* in linear fashion in the direction of the machining axis 34*a* of the hand-held power tool; in the present exemplary embodiment, the balancing unit 32*a* is embodied in the form of a disk-shaped component. The rods 46*a*, 48*a* constitute a restrictive guidance and preferably, their ends are secured in the hand-held power tool in a suitable fashion. They extend essentially parallel to the drive shaft 12*a*. The drive shaft 12*a* and the guide 36*a* of the piston 30*a* embodied in the form of a hammer tube extend through the disk-shaped balancing unit 32*a*, which contains two bores 50*a* and 52*a* that each accommodate a respective rod 46*a*, 48*a* in sliding fashion. The balancing unit 32*a* is thus supported so that it can be moved back and forth in the hand-held power tool, parallel to the rotation axis 42*a* of the drive shaft 12*a* so that the wobble finger 18*a* converts a rotary motion of the drive shaft 12*a* into a translatory motion of the piston 30*a* and the other wobble finger 20*a* converts a rotary motion of the drive shaft 12*a* into a translatory motion of the balancing unit 32*a*.

During operation of the hand-held power tool, the drive shaft 12*a* and the wobble bearing 14*a* are rotated in tandem. Because of the oblique arrangement of the inner raceway 40*a* of the wobble bearing 14*a*, the rolling elements 38*a* revolving in it and together with them, the wobble plate 16*a*, are set into a wobbling motion that is converted into a linear reciprocating motion of the elements 26*a*, 28*a* through the guidance of the elements 26*a*, 28*a*. The first wobble finger 18*a* converts the rotary motion of the drive shaft 12*a* into a reciprocating motion of the piston 30*a* along the machining axis 34*a* in the guide 36*a* of the impact mechanism. At the same time, the second wobble finger 20*a* converts the rotary motion of the drive shaft 12*a* into a reciprocating motion of the balancing unit 32*a* parallel to the rotation axis 42*a* of the drive shaft 12*a*; the direction of the rotation axis 42*a* and the direction of the machining axis 34*a* essentially coincide with each other.

In the second exemplary embodiment according to FIGS. 3 and 4, the balancing unit 32*b* can be rotated around a rotation axis 58*b* so that the wobble finger 18*b* converts a rotary motion of the drive shaft 12*b* into a translatory motion of the piston 30*b* and the other wobble finger 20*b* converts a rotary motion of the drive shaft 12*b* into a translatory and/or rotary motion of the balancing unit 32*b*.

During operation of the hand-held power tool, the drive shaft 12*b* and the wobble bearing 14*b* are rotated in tandem. Because of the oblique arrangement of the inner raceway 40*b* of the wobble bearing 14*b*, the rolling elements 38*b* revolving in it and together with them, the wobble plate 16*b*, are set into a wobbling motion that is converted into a linear reciprocating motion and/or rotary motion of the elements 26*b*, 28*b* through the guidance and support of the elements 26*b*, 28*b*. The first wobble finger 18*b* converts the rotary motion of the drive shaft 12*b* into a reciprocating motion of the piston 30*b* along the machining axis 34*b* in the guide 36*b* embodied as a hammer tube of the impact mechanism. At the same time, the second wobble finger 20*b* converts the rotary motion of the drive shaft 12*b* into a movement of the balancing unit 32*b* around the rotation axis 58*b* and/or a reciprocating motion of the balancing unit 32*b* parallel to the rotation axis 42*b* of the drive shaft 12*b*; the direction of the rotation axis 42*b* and the direction of the machining axis 34*b* essentially coincide with each other.

The foregoing relates to the preferred exemplary embodiments of the invention, it being understood that other variants and embodiments thereof are possible within the spirit and scope of the invention, the latter being defined by the appended claims.

The invention claimed is:

1. A wobble drive of a hand-held power tool, having a drive shaft with a wobble bearing situated on the drive shaft and having a wobble plate mounted on the wobble bearing, the wobble plate being provided with at least two wobble fingers, each with a respective wobble finger axis, wherein axes of the wobble fingers enclose an angle not equal to 180°, wherein the angle between the axes of the wobble fingers is adjustable.

2. The wobble drive as recited in claim 1, wherein an adjustment of the angle is carried out by means of a movable support of at least one wobble finger on the wobble plate.

3. A wobble drive of a hand-held power tool, having a drive shaft with a wobble bearing situated on the drive shaft and having a wobble plate mounted on the wobble bearing, the wobble plate being provided with at least two wobble fingers, each with a respective wobble finger axis, wherein axes of the wobble fingers enclose an angle not equal to 180°, wherein the axes enclose an angle of between the ranges of 10° and 170° and 190° and 350°, and wherein the angle between the axes of the wobble fingers is adjustable.

4. The wobble drive as recited in claim 3, wherein an adjustment of the angle is carried out by means of a movable support of at least one wobble finger on the wobble plate.

5. A wobble drive of a hand-held power tool, having a drive shaft with a wobble bearing situated on the drive shaft and having a wobble plate mounted on the wobble bearing, the wobble plate being provided with at least two wobble fingers, each with a respective wobble finger axis, wherein axes of the wobble fingers enclose an angle not equal to 180°, wherein one wobble finger converts a rotary motion of the drive shaft into a translatory motion of an element embodied as a piston of an impact mechanism of the hand-held power tool, and the other wobble finger converts a rotary motion of the drive shaft into a translatory or rotary motion of another element embodied as a balancing unit, and wherein the balancing unit encompasses both the drive shaft and a guide of the piston such that the drive shaft and the guide of the piston extend through the balancing unit.

6. The wobble drive as recited in claim 5, wherein at least one element is guided in linear fashion.

7. The wobble drive as recited in claim 6, wherein the at least one element is a piston of an impact mechanism of the hand-held power tool or a balancing unit.

8. The wobble drive as recited in claim 7, wherein the balancing unit is guided essentially in a direction of a machining axis of the hand-held power tool or in a direction of an axis oriented obliquely in space in relation to a machining axis of the hand-held power tool.

9. The wobble drive as recited in claim 7, wherein the balancing unit is rotatable around a rotation axis.

10. The wobble drive as recited in claim 5, wherein the at least one element is a piston of an impact mechanism of the hand-held power tool or a balancing unit.

11. The wobble drive as recited in claim 10, wherein the balancing unit is guided essentially in a direction of a machining axis of the hand-held power tool or in a direction of an axis oriented obliquely in space in relation to a machining axis of the hand-held power tool.

12. The wobble drive as recited in claim 11, wherein the balancing unit is embodied as a disk-shaped component.

13. The wobble drive as recited in claim 11, wherein the balancing unit is embodied as a U-shaped component.

14. The wobble drive as recited in claim 11, wherein the balancing unit at least partially encompasses the drive shaft.

15. The wobble drive as recited in claim 11, wherein the balancing unit at least partially encompasses the drive shaft and a guide of the piston.

16. The wobble drive as recited in claim 10, wherein the balancing unit is rotatable around a rotation axis.

17. The wobble drive as recited in claim 10, wherein the balancing unit is embodied in the form of a disk-shaped or U-shaped component.

18. The wobble drive as recited in claim 17, wherein the balancing unit at least partially encompasses the drive shaft and/or a guide of the piston.

19. A hand-held power tool having a wobble drive according to claim 5, wherein the hand-held power tool is from a group of rotary hammers, chisel hammers, or rotary and chisel hammers.

* * * * *